US008628081B2

(12) United States Patent
Michels et al.

(10) Patent No.: US 8,628,081 B2
(45) Date of Patent: Jan. 14, 2014

(54) DEVICE FOR HANDLING VALUE NOTES

(75) Inventors: Andre Michels, Borgentreich (DE); Heinz Strohdiek, Paderborn (DE); Heinz Saathoff, Bueren (DE)

(73) Assignee: Wincor Nixdorf International GmbH (DE)

( * ) Notice: Subject to any disclaimer, the term of this patent is extended or adjusted under 35 U.S.C. 154(b) by 64 days.

(21) Appl. No.: 13/504,904

(22) PCT Filed: Nov. 9, 2010

(86) PCT No.: PCT/EP2010/067109

§ 371 (c)(1), (2), (4) Date: May 8, 2012

(87) PCT Pub. No.: WO2011/054964

PCT Pub. Date: May 12, 2011

(65) Prior Publication Data

US 2012/0217130 A1 Aug. 30, 2012

(30) Foreign Application Priority Data

Nov. 9, 2009 (DE) ..... 10 2009 052 379

(51) Int. Cl.
*G07D 11/00* (2006.01)
*B65H 29/60* (2006.01)

(52) U.S. Cl.
CPC ..... *G07D 11/00* (2013.01); *B65H 29/60* (2013.01); *Y10S 902/15* (2013.01)
USPC ..... 271/303; 198/624; 902/15

(58) Field of Classification Search
USPC ..... 198/367, 624; 271/225, 272–274, 271/303–305, 186, 902; 902/13–17; 209/534
See application file for complete search history.

(56) References Cited

U.S. PATENT DOCUMENTS 3,815,898 A * 6/1974 Haifley et al. ..... 271/65
4,871,125 A * 10/1989 Haueter ..... 242/528

(Continued)

FOREIGN PATENT DOCUMENTS

DE 202008006688 U1 10/2008
EP 1544144 A1 6/2005

(Continued)

OTHER PUBLICATIONS

International Search Report (in English) and Written Opinion (in German) for PCT/EP2010/067109, mailed Feb. 9, 2011; ISA/EP.

(Continued)

*Primary Examiner* — Mark A Deuble
(74) *Attorney, Agent, or Firm* — Harness, Dickey & Pierce, P.L.C.

(57) ABSTRACT

The invention relates to a device (10) for handling notes of value, comprising a first transport path (12), a second transport path (14) and at least one third transport path (16), wherein the notes of value can be transported along each transport path (12, 14, 16). Further, the device (10) has a switch (18) via which the three transport paths (12 to 16) can be connected to each other and with the aid of which the notes of value can be derouted from one of the transport paths (12 to 16) in another one. At least one transport element (26 to 30) is assigned to each of the transport paths (12 to 16) with the aid of which the notes of value can be supplied from the switch (18) to the respective transport path (12 to 16) or vice versa from the respective transport path (12 to 16) to the switch (18). The three transport elements (26 to 30) are driven by the same drive unit, wherein the direction of rotation of at least one of the transport elements (30) can be reversed independently from the direction of rotation of the other two transport elements (26, 28) relative to the direction of rotation of the other two transport elements (26, 28).

15 Claims, 11 Drawing Sheets

(56) References Cited

U.S. PATENT DOCUMENTS

| | | | | |
|---|---|---|---|---|
| 5,536,002 | A * | 7/1996 | Yoshida et al. | 271/264 |
| 6,129,349 | A | 10/2000 | Olbrich et al. | |
| 6,394,446 | B1 * | 5/2002 | Okamoto | 271/186 |
| 7,950,653 | B2 * | 5/2011 | Berendes | 271/225 |
| 2001/0000462 | A1 | 4/2001 | Blackman et al. | |
| 2002/0162775 | A1 * | 11/2002 | Saltsov et al. | 209/534 |
| 2006/0163027 | A1 | 7/2006 | Hobmeier et al. | |
| 2010/0194033 | A1 | 8/2010 | Berendes | |
| 2011/0017766 | A1 | 1/2011 | Michels et al. | |

FOREIGN PATENT DOCUMENTS

| | | | |
|---|---|---|---|
| WO | WO-03077209 | A2 | 9/2003 |
| WO | WO-2009018879 | A1 | 2/2009 |

OTHER PUBLICATIONS

English Translation of International Preliminary Report on Patentability for PCT/EP2010/067109 (May 24, 2012).

* cited by examiner

DEVICE FOR HANDLING VALUE NOTES

CROSS-REFERENCE TO RELATED APPLICATIONS

This application is a National Stage of International Application No. PCT/EP2010/067109, filed Nov. 9, 2010, and published in German as WO 2011/054964 A1 on May 12, 2011. This application claims the benefit and priority of German Application No. 10 2009 052 379.0, filed Nov. 9, 2009. The entire disclosures of the above applications are incorporated herein by reference.

BACKGROUND

This section provides background information related to the present disclosure which is not necessarily prior art.

1. Technical Field

The invention relates to a device for handling notes of value which has a first, a second and a third transport path, wherein the notes of value can be transported along each transport path. Further, the device has a switch via which the three transport paths can be connected to each other and with the aid of which the notes of value can be rerouted from one of the transport paths to another of the transport paths according to the switch position. Further, the device comprises a first transport element with the aid of which the notes of value can be supplied from the switch to the first transport path and/or from the first transport path to the switch, a second transport element with the aid of which the notes of value can be supplied from the switch to the second transport path and/or from the second transport path to the switch and a third transport element with the aid of which the notes of value can be supplied from the switch to the third transport path and/or from the third transport path to the switch.

2. Discussion

The device is in particular an automated teller machine, an automatic cash register system and/or an automatic cash safe. When depositing and/or withdrawing notes of value they are transported along transport paths, wherein the notes of value can be rerouted with the aid of the switch between three transport paths. The switch is therefore also referred to as three-way-switch. In order to realize all possible transport directions between the three transport paths, i.e. in order to reroute the notes of value from each of the three transport paths in any other of the three transport paths with the aid of the switch, it is necessary that the direction of rotation of at least one of the transport elements can be reversed relative to the direction of rotation of the other transport elements.

In known three-way-switches this is realized by driving two of the transport elements via a central drive unit of the device, while the third transport element is driven via a separate drive unit such that the direction of rotation of the third transport element can be adjusted independently from the direction of rotation of the central drive unit and thus the direction of rotation of the first two transport elements. What is disadvantageous here is that by providing a separate drive unit for the third transport element installation space is required and costs incur.

From Document WO 2009/018879 A1 a three-way-switch, for redirecting sheet-shaped media is known

SUMMARY OF THE INVENTION

It is an object of the invention to specify a device for handling notes of value with the aid of which notes of value can be transported easily between various transport paths and which has a simple and compact design.

In the device according to the invention, the three transport elements are driven with the aid of the same drive unit, wherein the direction of rotation of at least one of the transport elements can be reversed relative to the direction of rotation of the other transport elements. In this way, it is achieved that now only one drive unit is required and still all transport directions between the three transport paths can be realized. Thus, the notes of value can be transported from each transport path in any other transport path without an additional separate drive unit being required. In this way, installation space is saved such that the device is constructed compact and cost-efficient. The drive unit is in particular a central drive unit of the device, in particular a central drive unit of an automated teller machine, an automatic cash register system and/or an automatic cash safe. By reversing the direction of rotation of one of the transport elements relative to the direction of rotation of the other transport elements is understood that the direction of rotation of said one transport element is reversed, while the direction of rotation of said other two transport elements is maintained or that the direction of rotation of said other two transport elements is reversed when the transport direction of said one transport element is maintained.

It is advantageous when in a first operating state, the first transport element has a first direction of rotation, the second transport element has a second direction of rotation and the third transport element has a third direction of rotation, and when in a second operating state, the first transport element has the first direction of rotation, the second transport element has the second direction of rotation and the third transport element has a fourth direction of rotation opposite to the third direction of rotation. Thus, in the second operating state relative to the first operating state, the directions of rotation of the first two transport elements are maintained, whereas the direction of rotation of the third transport element is reversed such that the direction of rotation of the third transport element is reversed relative to the direction of rotation of the first two transport elements. Thus, it is achieved that all possible transport directions can be realized, i.e. that the notes of value can be transported both from the first to the second, from the second to the first, from the second to the third, from the third to the second, from the first to the third and from the third to the first transport path.

Further, it is advantageous when in a third operating state, the first transport element is driven with a fifth direction of rotation opposite to the first direction of rotation, the second transport element is driven with a sixth direction of rotation opposite to the second direction of rotation and the third transport element is driven with the third direction of rotation. In this way, it is in turn achieved that by switching between the first and the third operating state all possible transport directions can be realized.

In a preferred embodiment of the invention, the first, the second and the third direction of rotation are identical such that in the first operating state, all transport elements are driven with the same direction of rotation. In this case, in the second operating state, the direction of rotation of the third transport element is reversed, while the direction of rotation of the first two transport elements is maintained. In contrast, when switching from the first in the third operating state the direction of rotation of the third transport element is maintained, while the direction of rotation of the first two transport elements is reversed.

In a preferred embodiment of the invention, notes of value can be transported from the first transport path to the second transport path and/or from the second transport path to the first transport path in a first switch position, notes of value can be transported from the first transport path to the third transport path and/or from the third transport path to the first transport path in a second switch position and notes of value can be transported from the second transport path to the third transport path and/or from the third transport path to the second transport path in a third switch position. In this way, it is achieved that according to the switch position all possible transport directions of the notes of value can be realized.

The switch comprises in particular a switch shaft on which at least one guiding finger, preferably a plurality of guiding fingers, for guiding the notes of value is arranged in a rotationally fixed manner. The switch shaft is engaged, in particular via a gear wheel assembly, with a cam disk, wherein the cam disk can be rotated with the aid of an adjustment unit in at least a first, a second and a third preset position, wherein the switch shaft is rotatable in one of the three switch positions according to the position of the cam disk. In this way, it is achieved that the three switch positions can be reliably adjusted via the cam disk in an easy manner. The switch shaft is connected to the cam disk in particular via a gear segment which is guided within a link of the cam disk via a pin. The link of the cam disk respectively includes a portion with a constant radius on the three preset positions such that the pin is also in case of low tolerances of the rotation of the cam disk arranged within this region with the same radius such that the switch shaft has the correct position.

In the first switch position and in the second switch position, the transport elements are preferably in the first operating state and in the third switch position, in the second operating state or in the third operating state. In order to realize all transport directions of the notes of value, the direction of rotation of the third transport element has to be changed relative to the direction of rotation of the other two transport elements only in case of one of the switch positions, whereas in case of the other two switch positions the direction of rotation of the transport elements can be maintained. It is advantageous when the direction of rotation is also only changed if necessary and unnecessary switching of the direction of rotation is prevented. In this way, wear of the respective component parts is reduced.

In an advantageous embodiment of the invention, the device comprises a reverse gear, which, in a first position of the third transport element, drives with the same direction of rotation with which the first transport element rotates and in a second position of the third transport element, drives with the direction of rotation opposite to the direction of rotation of the first transport element. In this way, it is easily achieved that all three transport elements can be driven via the drive unit and the direction of rotation of the third transport element can be reversed relative to the direction of rotation of the first and the second transport element independently from the direction of rotation of the first two transport elements. The reverse gear is in particular a tumbler gear.

The reverse gear comprises in particular a first gear wheel which in a first position meshes with a gear wheel connected to the third transport element in a rotationally fixed manner, which in a second position meshes with the gear wheel connected to the transport element in a rotationally fixed manner, wherein in the first position the second gear wheel does not contact the gear wheel connected to the third transport element in a rotationally fixed manner and in the second position the first gear wheel does not contact the gear wheel connected to the third transport element in a rotationally fixed manner and the first gear wheel and the second gear wheel are engaged with each other. In this way, it is achieved that by pivoting the reverse gear the gear wheel connected to the third transport element can be selectively engaged with the first and the second gear wheel. As the first and the second gear wheel mesh with each other, they have different directions of rotation. Depending on with which gear wheel the gear wheel firmly connected to the transport element meshes, thus also the direction of rotation of the third transport element is reversed. Here, the first gear wheel and the second gear wheel and thus in turn also the third transport element are driven via the drive unit. Here, the reverse gear is mainly driven via a central drive unit of the device.

It is advantageous when the reverse gear is connected to the switch such that in case of an adjustment of the switch positions the reverse gear is also pivoted from the first in the second position, when this is necessary for the desired transport direction. It is particularly advantageous when this pivoting of the gear takes place automatically according to the switch position. In this way, it is achieved that no improper adjustments of the reverse gear relative to the switch occur and thus notes of value jams are prevented.

It is in particular advantageous when the reverse gear is connected to the switch via a coupling element and when an adjustment unit is provided which adjusts the switch position of the switch. In the first switch position the reverse gear is arranged in the first position, in the second switch position the reverse gear is also arranged in the first position and only in the third switch position the reverse gear is arranged in the second position. In this way, it is achieved that the reverse gear is only adjusted during the adjustment from the first in the third or from the second in the third switch position or vice versa from the third in the first or from the third in the second switch position such that an unnecessary adjustment of the reverse gear and thus unnecessary wear is prevented. The adjustment unit pivots via the connection via the coupling element the reverse gear from the first position in the second position when the locking unit adjusts the switch from the first switch position in the third switch position or from the second switch position in the third switch position. Likewise, the adjustment unit pivots via the connection via the coupling element the reverse gear from the second position in the first position when the locking unit adjusts the switch from the third switch position in the first switch position or from the third switch position in the second switch position. By this purely mechanical coupling between the adjustment unit and the reverse gear it is achieved that no electronics is required for the control of the reverse gear and thus the complexity and the fault liability are reduced.

A pin stationarily connected to the coupling element can be guided within an oblong hole of a first guiding element connected to the reverse gear, wherein the pin is additionally guided within a groove of a stationary second guiding element. The second guiding element is in particular stationarily connected to a housing or a rack. The groove of the second guiding element comprises a first and a second leg, wherein the first leg and the second leg span an angle between 100° and 170°, in particular between 120° and 150°. By the double guidance of the pin within the oblong hole connected to the reverse gear and the stationarily arranged groove it is achieved that the reverse gear is only pivoted from the first position in the second position when the adjustment unit adjusts the switch from the first switch position in the third switch position or from the second switch position in the third switch position, and is only pivoted from the second position in the first position when the adjustment unit adjusts the switch from the third switch position in the first switch position or from the third switch position in the second switch position. In this way, in particular a simple mechanical arrangement is made possible by means of which the reverse gear is only pivoted automatically along during the adjustment of the switch, when this is necessary for the intended transport direction.

The transport elements can respectively comprise at least one roll, at least one belt and/or at least one roller. The transport elements comprise in particular respectively one pair of rolls which comprises preferably a drive roll driven by the drive unit and a non-driven pressure roll. The notes of value are transported through these rolls. In this way, a secure guidance of the notes of value is achieved and notes of value jams and damage of the notes of value are prevented.

The drive unit comprises in particular an electric motor, preferably a DC motor or a stepper motor.

The first transport element is in particular arranged on a first shaft in a rotationally fixed manner, the second transport element is arranged on a second shaft in a rotationally fixed manner and the third transport element is arranged on a third shaft in a rotationally fixed manner. The reversal of the direction of rotation of the individual transport elements relative to the direction of rotation of the other two transport elements is achieved by reversing the shaft on which said one transport element is arranged relative to the direction of rotation of the other two shafts.

BRIEF DESCRIPTION OF THE DRAWINGS

The drawings described herein are for illustrative purposes only of selected embodiments and not all possible implementations, and are not intended to limit the scope of the present disclosure.

Further features and advantages of the invention result from the following description which in connection with the enclosed Figures explains the invention in more detail with reference to embodiments.

Corresponding reference numerals indicate corresponding parts throughout the several views of the drawings.

DETAILED DESCRIPTION OF THE PREFERRED EMBODIMENTS

Example embodiments will now be described more fully with reference to the accompanying drawings.

Figure 1:
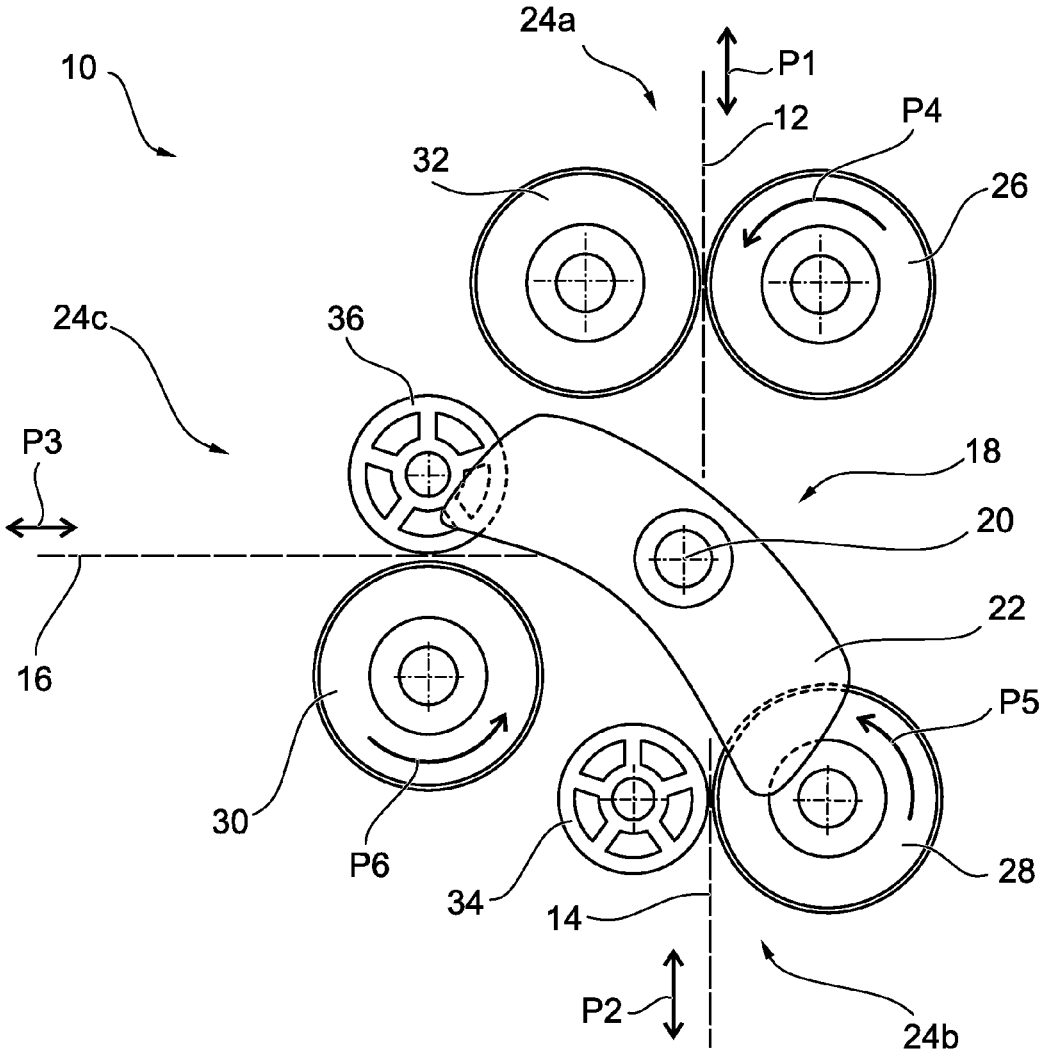
FIG. 1 shows a schematic illustration of a device for handling notes of value.

In FIG. 1, a schematic illustration of a section of a device 10 for handling notes of value is illustrated. The device 10 is in particular an automated teller machine, an automatic cash register system and/or an automatic cash safe. When depositing and/or withdrawing notes of value the notes of value are transported along various transport paths within the device 10. In FIG. 1, a first transport path 12, a second transport path 14 and a third transport path 16 are shown along which the notes of value can be transported. The three transport paths 12 to 16 are connected to each other via a switch 18 with the aid of which the notes of value can be rerouted according to the switch position of the switch 18 between the transport paths 12 to 16. The switch 18 comprises a switch shaft 20 on which a plurality of guiding fingers stationarily connected thereto are arranged, along which surface of the guiding fingers the notes of value are guided and thus rerouted between the transport paths 12 to 16 according to the switch position. One of these guiding fingers is exemplarily identified with the reference sign 22. The guiding fingers 22 are in particular shaped like a double-wing boomerang.

The device 10 comprises three pairs of rolls 24*a* to 24*c*, which respectively comprise at least one driven drive roll 26 to 30. The drive rolls 26 to 30 can be driven via a central drive unit of the device 10. The first pair of rolls 24*a* in addition to the driven drive roll 26 has a further driven roll 32. Whereas the other two pairs of rolls 24*b*, 24*c* in addition to the drive rolls 28, 30 respectively have one pressure roll 34, 36 which is not driven itself. In an alternative embodiment of the invention, the roll 32 of the first pair of rolls 24*a* can also be a non-driven pressure roll. During the transport along the transport paths 12 to 16 the notes of value are transported through the rolls 26 to 36 of the respective transport paths 12 to 16. As indicated by the double arrow P1, the notes of value can be supplied from the first transport path 12 to the switch 18 and from the switch 18 to the first transport path 12 with the aid of the first pair of rolls 24*a*. As indicated by the double arrow P2, the notes of value can likewise be supplied from the second transport path 14 to the switch 18 and from the switch 18 to the second transport path 14 with the aid of the second pair of rolls 24*b*. Corresponding to the double arrow P3 the notes of value can be supplied from the third transport path 16 to the switch 18 and vice versa from the switch 18 to the third transport path 16 with the aid of the third pair of rolls 24*c*. The direction of rotation of the central drive unit can be reversed such that the directions of rotation of the drive rolls 26 to 30 can also be reversed. In this way, depending on the rotation, the notes of value can be supplied from the respective transport path 12 to 16 to the switch 18 and from the switch 18 to the respective transport path 12 to 16.

As already mentioned, the drive rolls 26 to 30 are driven by a central drive unit of the device 10, in particular an electric motor. For this, the drive rolls 26 to 30 are in particular connected via a shaft, a belt, a chain and/or a gear wheel arrangement to the drive unit and/or to each other. In a first operating state, the drive rolls 26 to 30 are all driven with the same first direction of rotation which is indicated by the arrows P4 to P6. When the direction of rotation of the central drive unit is reversed, the directions of rotation of the drive rolls 26 to 30 are reversed as well such that said drive rolls 26 to 30 are driven opposite to the arrows P4 to P6 but still all have the same direction of rotation. In this operating state, in which the three drive rolls 26 to 30 have the same direction of rotation, the notes of value can be supplied from the first transport path 12 to the second transport path 14, from the first transport path 12 to the third transport path 16, from the second transport path 14 to the first transport path 12 and from the third transport path 16 to the first transport path 12.

However, in order to supply the notes of value from the second transport path 14 to the third transport path 16 or from the third transport path 16 to the second transport path 14, the direction of rotation of the second drive roll 28 or the third drive roll 30 has to be reversed relative to the direction of rotation of the other two drive rolls 26 to 30. Therefore, in the present embodiment, the direction of rotation of the drive roll 30 is reversed relative to the direction of rotation of the other two drive rolls 26, 28 in order to transport the notes of value between the second transport path 14 and the third transport path 16. In this second operating state, the first and the second drive roll 26, 28 rotate in the direction of the arrows P5 and P6, whereas the third drive roll 30 is rotated opposite to the direction of rotation of the first and the second drive roll 26, 28 and thus opposite to the direction of the arrow P6. Vice versa, the first and the second drive roll 26, 28 can likewise rotate opposite to the arrows P4 and P5 and the third drive roll 30 can rotate in the direction of the arrow P6.

Alternatively, it is also possible that in a third operating state, the direction of rotation of the first drive roll 26, 28 is reversed relative to the direction of rotation of the third drive roll 30 to realize thus also all possible transport directions of the notes of value between the transport paths 12 and 16. Likewise it is possible that not the direction of rotation of the third drive roll 30 is reversed relative to the direction of rotation of the first and second drive roll 26, 28, but that the direction of rotation of the first drive roll 26 is reversed relative to the direction of rotation of the second and the third drive roll 28, 30 or that the direction of rotation of the second drive roll 28 is reversed relative to the direction of rotation of the first and third drive roll 26, 30. Crucial is only that the direction of rotation of one of the drive rolls 26 to 30 can be reversed relative to the direction of rotation of the other two drive rolls 26 to 30 regardless in which direction of rotation the other two drive rolls rotate. Only in this way it is possible that the notes of value can be transported in any direction between the transport paths 12 to 16 according to the switch position.

The precise mechanical arrangement which is used for reversing the direction of rotation of the third drive roll 30 relative to the direction of rotation of the first and the second drive roll 26, 28 will be described below in more detail in connection with FIGS. 6 and 7. In an alternative embodiment of the invention, rollers and/or belts can be used instead of rolls 26 to 36.

Figure 2:
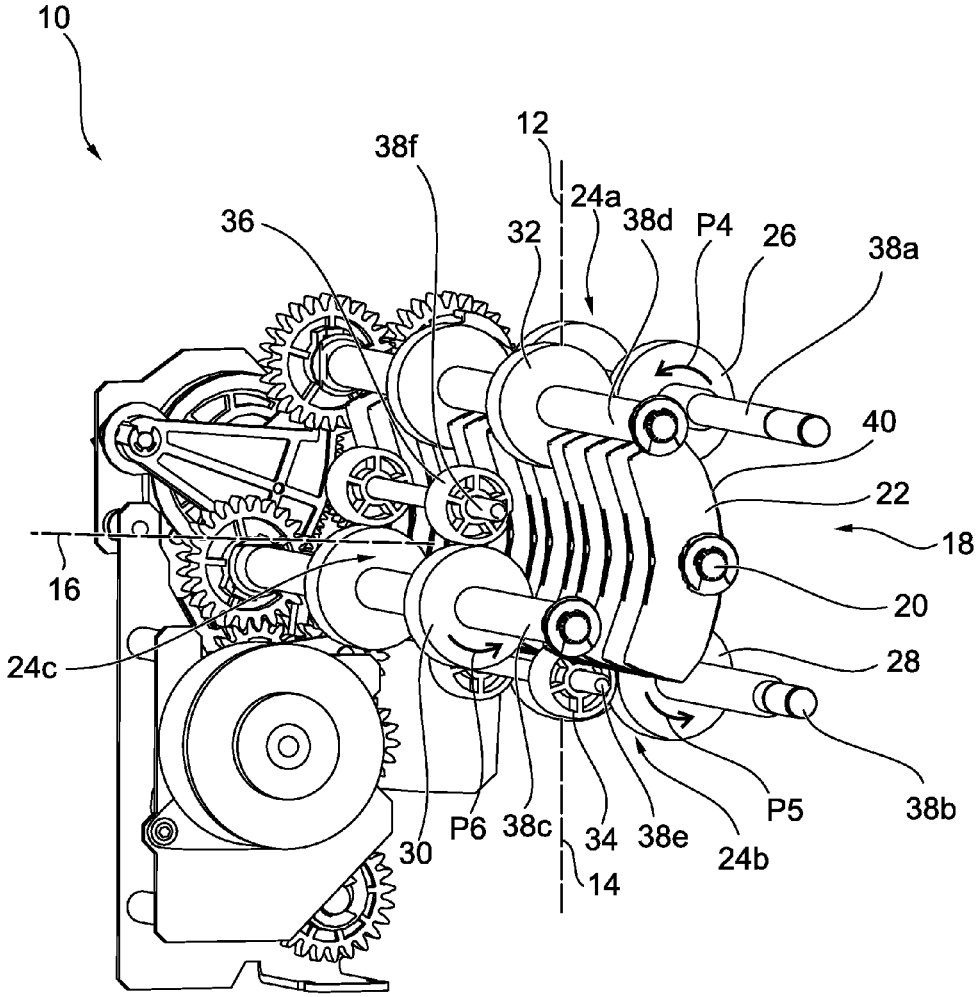
FIG. 2 shows a schematic perspective illustration of the device according to FIG. 1 in a first switch position of a switch.

In FIG. 2, a schematic perspective illustration of the device 10 according to FIG. 1 in a first switch position of the switch 18 is shown. Elements having the same structure or the same function are identified with the same reference signs.

As can be seen very well in FIG. 2 not only a pair of rolls 24*a* to 24*c* is assigned to each transport path 12 to 16, but each transport path also comprises a further pair of rolls arranged in parallel to the respective pair of rolls 24*a* to 24*c*. As the respective rolls of the pair of rolls 24*a* to 24*c* belonging to one transport path are respectively arranged on a common shaft 38*a* to 38*f* and are connected thereto in a rotationally fixed manner, the further pairs of rolls, being illustrated for the first time in FIG. 2, rotate according to the pair of rolls 24*a* to 24*c* being assigned to the respective transport path 12 to 16 such that in the further description respectively only the pair of rolls 24*a* to 24*c* being illustrated in the front position is indicated and described in the following. The explanations shall apply accordingly to the further pairs of rolls.

In an alternative embodiment of the invention, also more than two pairs of rolls can be arranged on the respective shafts 38*a* to 38*f*. The more pairs of rolls 24*a* to 24*c* are arranged on the respective shafts 28*a* to 28*f*, the more securely the notes of value are guided during the transport along the transport paths 12 to 16 and the more securely banknote jams are prevented.

The shafts 38*a* to 38*d* are connected via a gear wheel arrangement to the central drive unit with the aid of which the shafts 28*a* to 28*d* and thus the pairs of rolls 24*a* to 24*c* can be driven. The central drive unit as well as the gear wheel arrangement, belt arrangement and/or shaft arrangement with the aid of which the individual shafts 38*a* to 38*d* are connected to each other, are not illustrated completely in FIG. 2 as well as in the following Figures, but are faded out for reasons of clarity of the invention.

In the first switch position illustrated in FIG. 2, the notes of value can be transported from the first transport path 12 to the second transport path 14 or from the second transport path 14 to the first transport path 12 depending on the direction of rotation of the first pair of rolls 24*a* and the second pair of rolls 24*b*. Here, the notes of value are guided along the outer edge surface 40 of the guiding fingers 20. In addition to the outer edge surface 40 of the guiding fingers 22 the notes of value are guided during the transport along the switch 18 by a guiding element being not illustrated and being designed complementary to the outer edge surface 40, between which guiding element and the outer edge surface 40 a slot is formed through which notes of value are guided.

Figure 3:
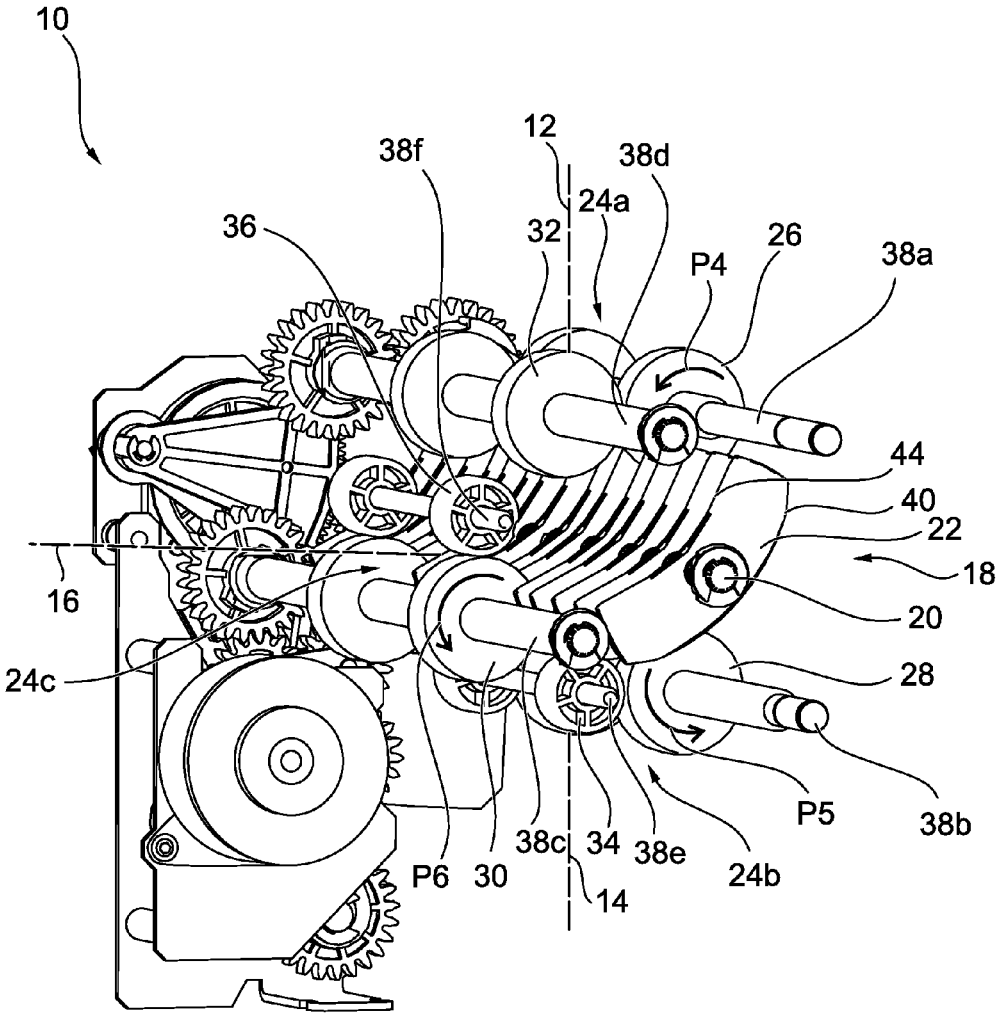
FIG. 3 shows a schematic perspective illustration of the device according to FIGS. 1 and 2 in a second switch position of the switch.

In FIG. 3, a schematic perspective illustration of the device 10 according to FIGS. 1 and 2 in a second switch position of the switch 18 is illustrated. In this second switch position, the notes of value are transported from the first transport path 12 to the third transport path 16 and from the third transport path 16 to the first transport path 12. Both in the first switch position illustrated in FIG. 2 and the second switch position illustrated in FIG. 3, the drive rolls 26 to 30 are respectively driven in the same direction P4, P5 or opposite to the direction P4, P5. In the second switch position shown in FIG. 3, the notes of value are guided along the inner edge surface 44 of the guiding fingers 22.

Figure 4:
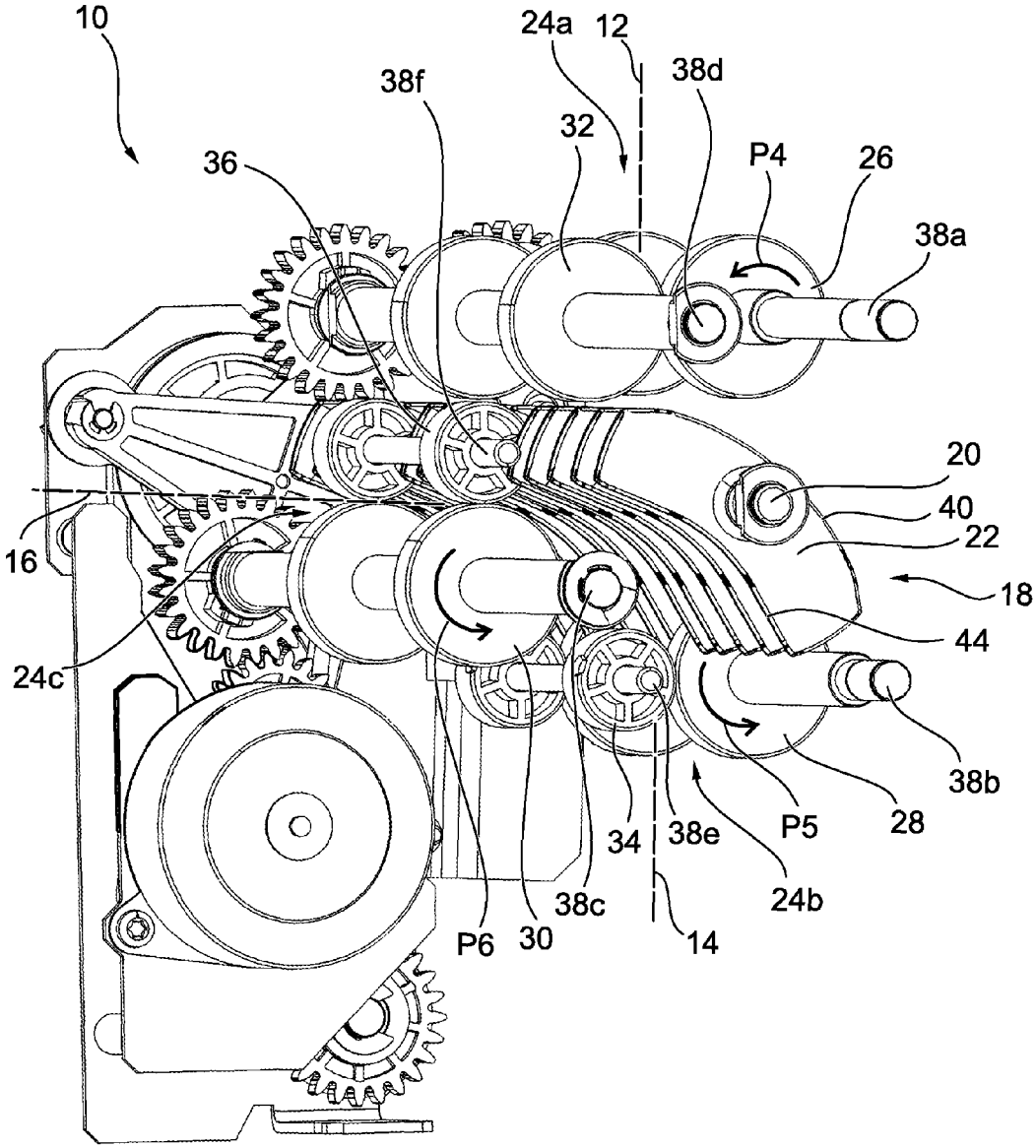
FIG. 4 shows a schematic perspective illustration of the device according to FIGS. 1 to 3 in a third switch position of the switch.

In FIG. 4, a schematic illustration of the device 10 according to FIGS. 1 to 3 in a third switch position of the switch 18 is shown. In this third switch position, the notes of value can be supplied from the second transport path 14 to the third transport path 16 and from the third transport path 16 to the second transport path 14. As in the second switch position, in the third switch position the notes of value are guided along the inner edge surface 44 of the guiding fingers 22. In the operating state shown in FIG. 4, the first and the second drive roll 26, 28 are driven in the direction of the arrows P4, P5, whereas the third drive roll 30 is driven opposite to the direction of the arrow P6. Vice versa, also the first and the second drive roll 26, 28 can be driven opposite to the arrows P4 and P5 and the third drive roll 30 can be driven in the direction of the arrow P6. Thus, the direction of rotation of the drive roll 30 is reversed relative to the direction of rotation of the first drive roll 26 and the second drive roll 28 compared to the first and second switch positions illustrated in FIGS. 2 and 3. In this way, it is achieved that the notes of value can also be transported between the second and the third transport path 14, 16.

Figure 5:
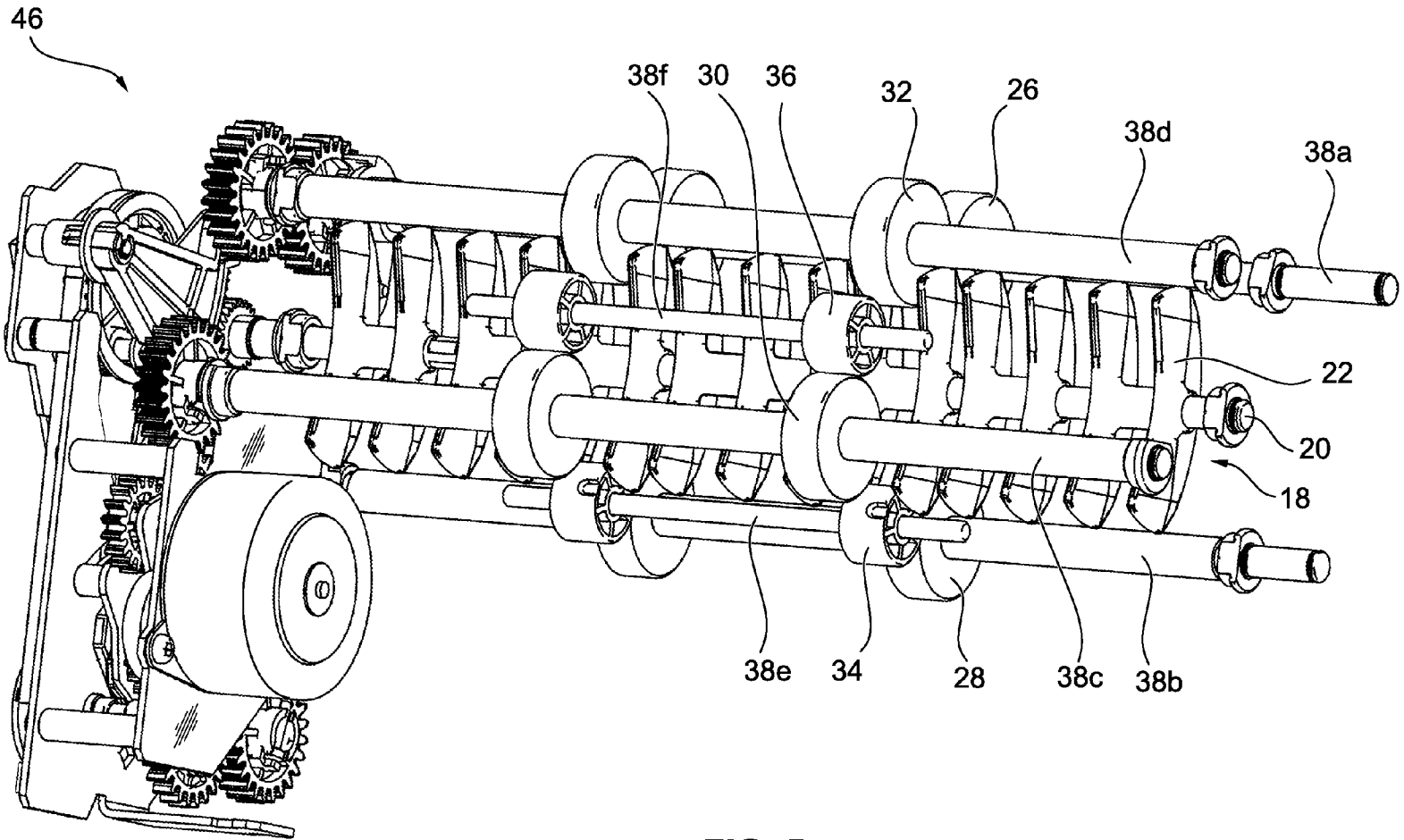
FIG. 5 shows a further schematic perspective illustration of the device according to FIGS. 1 to 4.

In FIG. 5, a schematic perspective illustration of the device 10 according to FIGS. 1 to 4 is illustrated. At the left edge of the drawing an adjustment arrangement 46 is illustrated with the aid of which the switch 18 can be adjusted between the three switch positions shown in FIGS. 2 to 4 and with the aid of which the direction of rotation of the third drive roll 30 can be reversed relative to the direction of rotation of the first drive roll 26 and the second drive roll 28. The adjustment arrangement 46 will be described in more detail below in connection with the following Figures.

Figure 6:
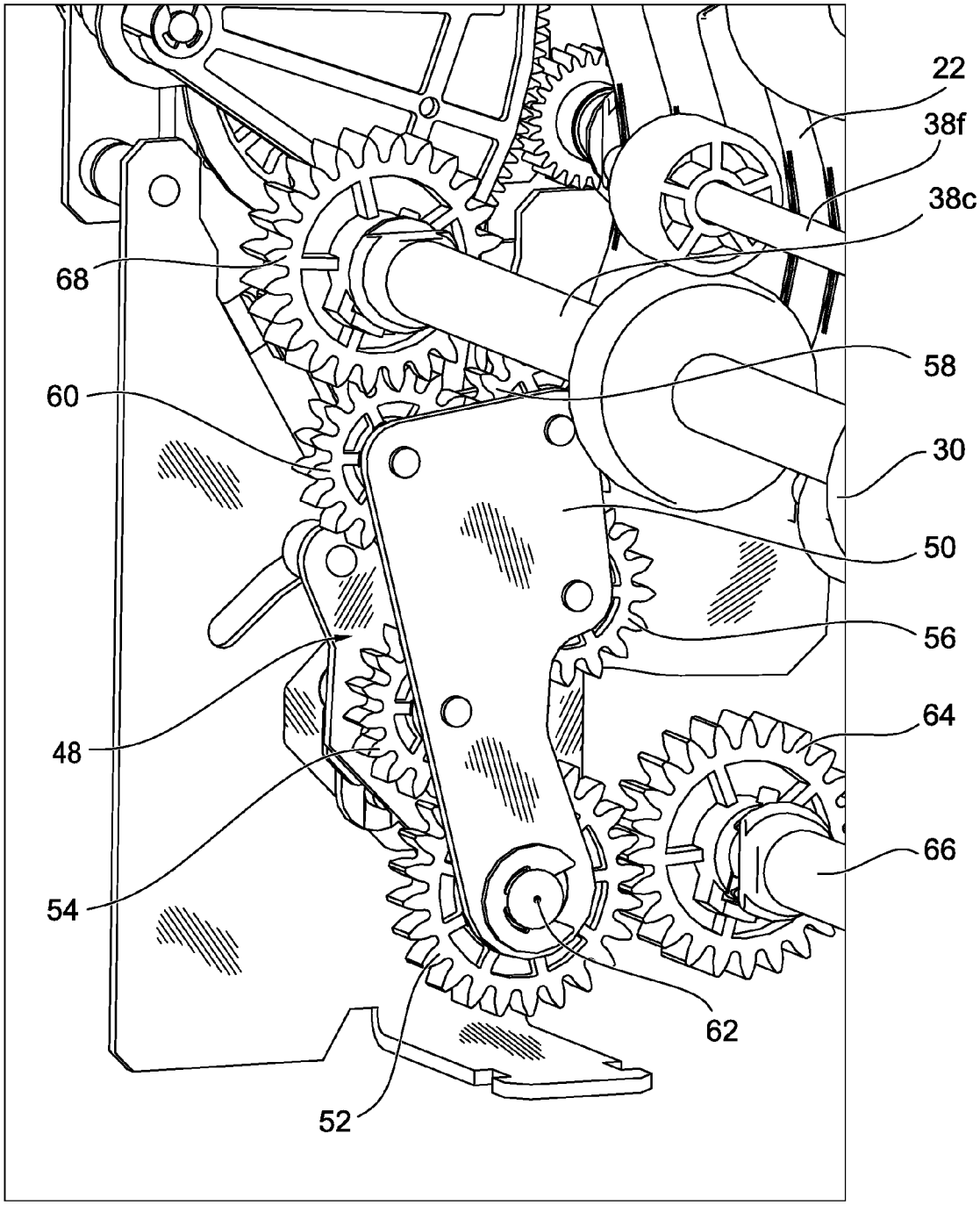
FIG. 6 shows a schematic perspective illustration of a reverse gear of the device according to FIGS. 1 to 5 in a first position.

In FIG. 6, a schematic perspective illustration of a section of the device 10 according to FIGS. 1 and 5 showing a reverse gear 48 is illustrated. The reverse gear 48 serves to reverse the direction of rotation of the third drive roll 30 relative to the direction of rotation of the other two drive rolls 26, 28.

The reverse gear 48 comprises a base plate 50 and five gear wheels 52 to 60. The first gear wheel 52 is, like the base plate 50, rotatably mounted about an axis 62. The first gear wheel 52 engages a gear wheel 64 which is connected to the central drive unit of the device 10 via a shaft 66.

The gear wheels 54 to 60 of the reverse gear 48 are rotatably connected to the base plate 50, wherein the first gear wheel 52 meshes with the second gear wheel 54, the second gear wheel 54 meshes with the third gear wheel 56, the third gear wheel 56 meshes with the fourth gear wheel 58 and the fourth gear wheel 58 meshes with the fifth gear wheel 60. Thus, all gear wheels 52 to 60 are driven by the central drive unit via the gear wheel 64. As the fourth gear wheel 58 directly meshes with the fifth gear wheel 60, the two gear wheels 50, 60 have a different direction of rotation.

In the first position of the reverse gear 40, illustrated in FIG. 6, the fifth gear wheel 60 of the reverse gear 48 meshes with a gear wheel 68, which is connected to the shaft 38*c* in a rotationally fixed manner, on which the third drive roll 30 is also arranged in a rotationally fixed manner. Thus, the third drive roll 30 is driven via the gear wheel 68 and the reverse gear 48 is driven by the central drive unit.

In the position illustrated in FIG. 6, the fifth gear wheel 60 is driven opposite to the direction of rotation of the gear wheel 64 such that in turn the gear wheel 68 and thus the drive roll 30 have the same direction of rotation as the gear wheel 64.

Figure 7:
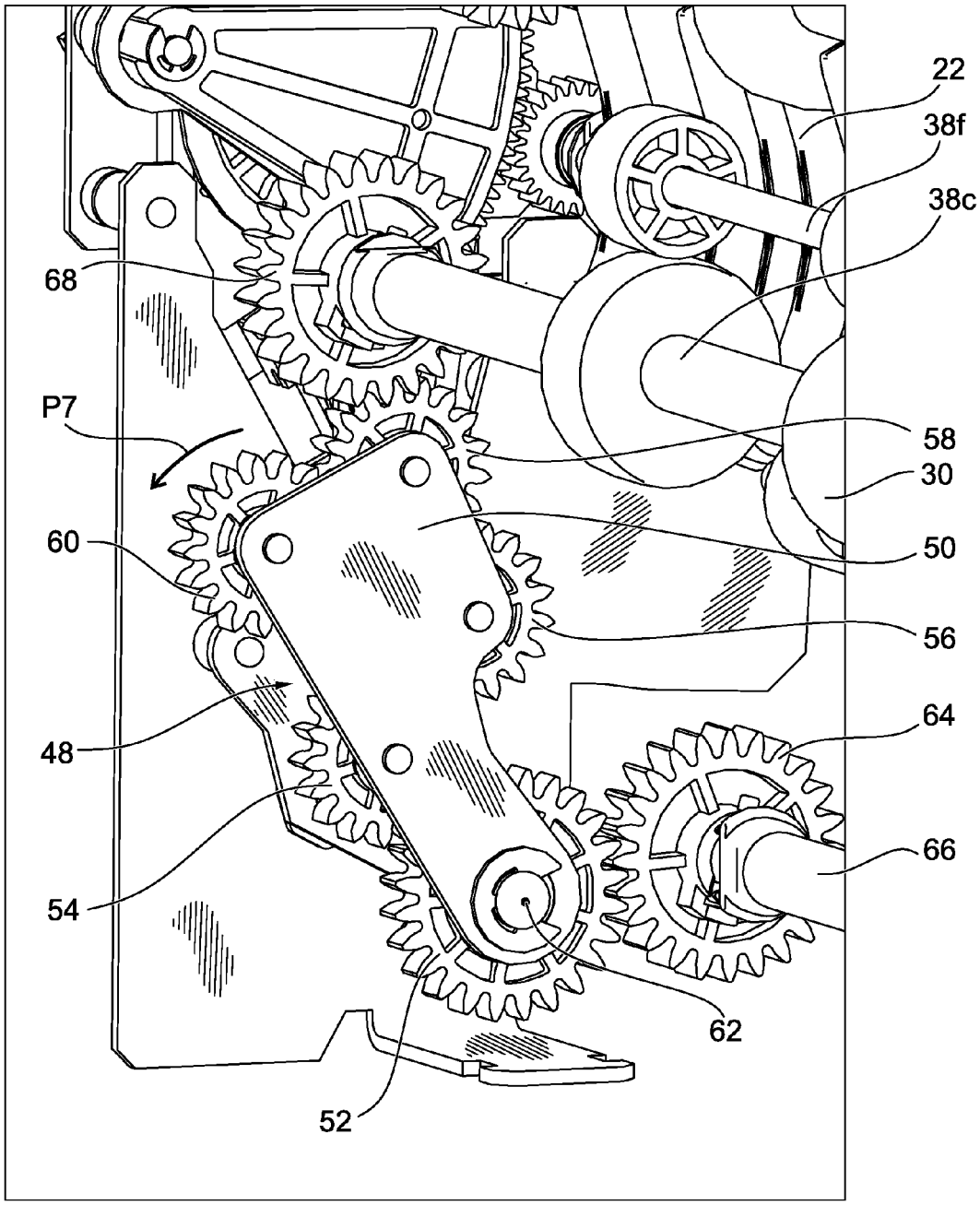
FIG. 7 shows a schematic perspective illustration of the reverse gear according to FIG. 6 in a second position.

In FIG. 7, a schematic illustration of a section of the device 10 according to FIGS. 1 to 6 is shown, wherein the reverse gear 48 is illustrated in a second position. In this second position, the gear wheel 68, which is firmly connected to the shaft 38*c*, meshes with the fifth gear wheel 58 of the reverse gear 48. Thus, in this second position, the gear wheel 68 is driven opposite to the direction of rotation of the gear wheel 64 and thus in the direction opposite to the direction of rotation in the first position.

For changing from the first position into the second position the reverse gear 48 is pivoted about the axis 62 in the direction of the arrow P7 until the gear wheel 68 is no longer engaged with the fifth gear wheel 60 and meshes with the fourth gear wheel 58. Vice versa, the reverse gear 48 is brought from the second position in the first position by pivoting it opposite to the direction of the arrow P7. Changing between the positions of the reverse gear 48 takes preferably place during the standstill of the drive unit and thus the gear wheels 52 to 60, 64, 68 or in case of low speed of the gear wheels 52 to 60, 64, 68. Alternatively, the adjustment of the reverse gear 48 can also take place while the gear wheels 52 to 60, 64, 68 rotate with the normal operating speed.

Figure 8:
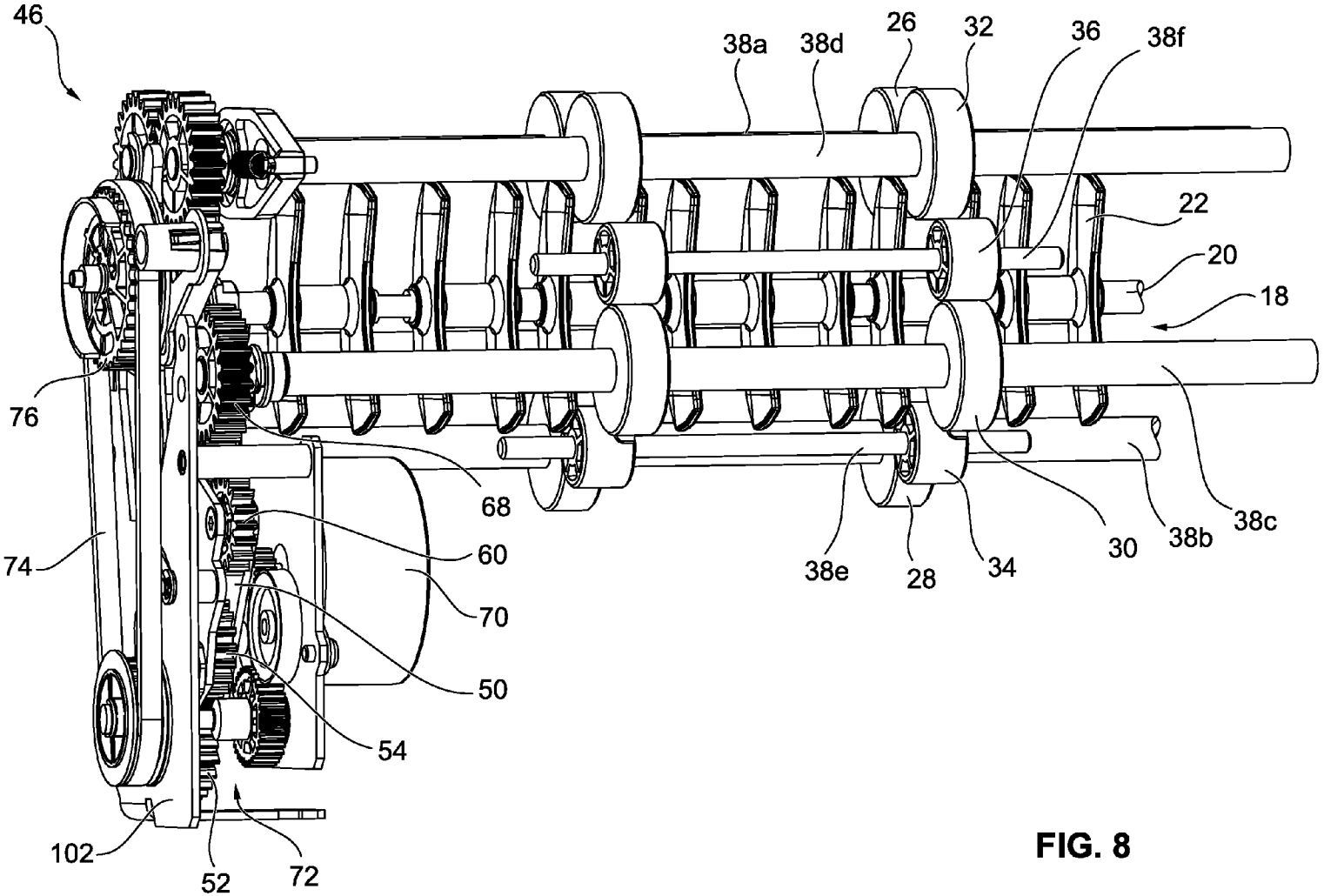
FIG. 8 shows a further schematic perspective illustration of the device according to FIGS. 1 to 7.

In FIG. 8, a further schematic perspective illustration of the device 10 according to FIGS. 1 to 7 is illustrated. The adjustment arrangement 46 comprises a stepper motor 70 which drives a belt 74 via a gear wheel arrangement 72. The belt 74 is engaged with a cam disk 76 which can be adjusted via the stepper motor 70, the gear wheel arrangement 72 and the belt 74 between various positions, whereby the three switch positions and the two positions of the reverse gear 48 can be adjusted, as it will be explained in more detail below in connection with FIGS. 9 to 11.

Figure 9:
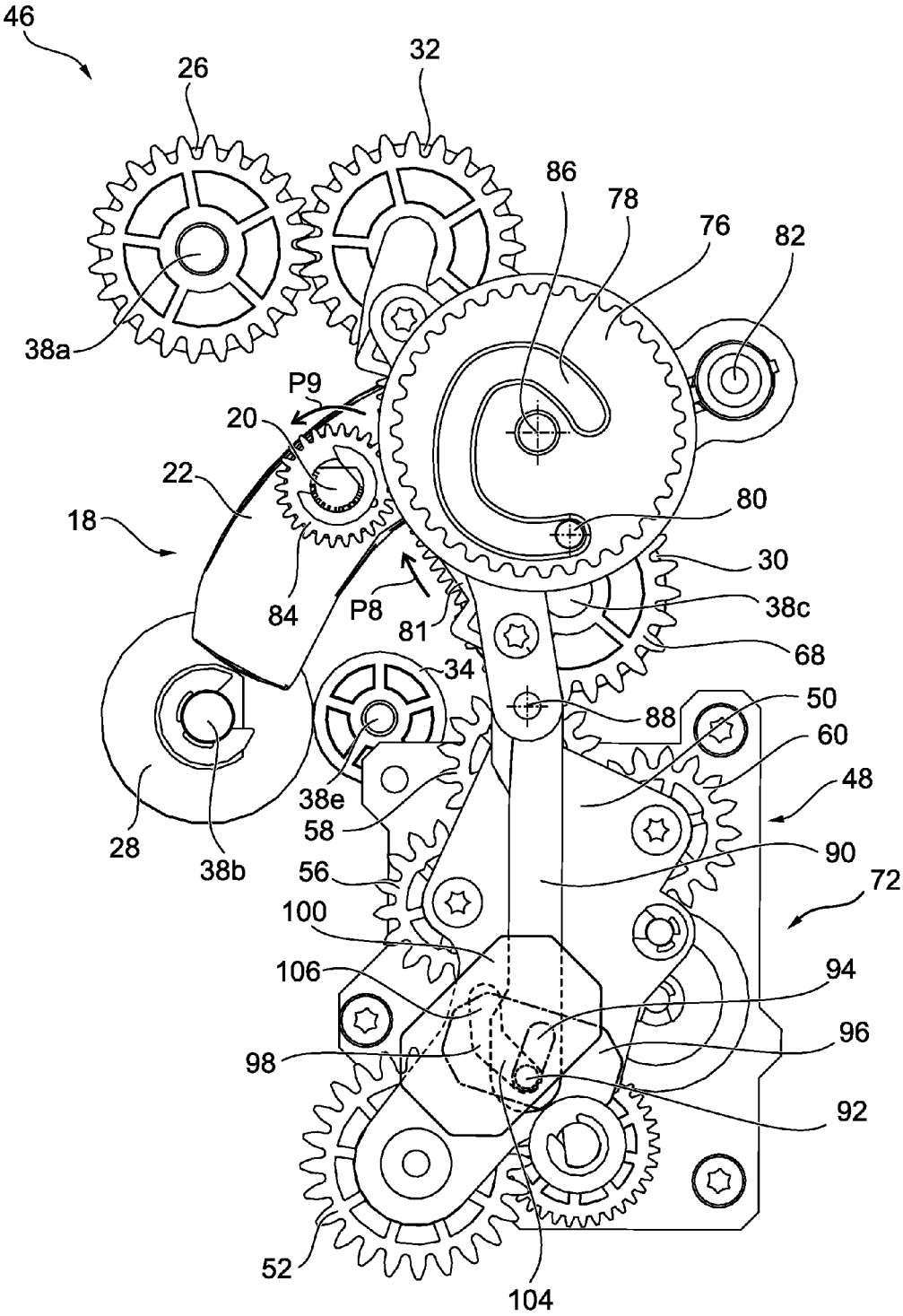
FIG. 9 shows a schematic illustration of an adjustment arrangement for adjusting the switch position and the position of the reverse gear in the third switch position and the second position of the reverse gear.

In FIG. 9, a schematic illustration of the adjustment arrangement 46 in the third switch position and the second position of the reverse gear 48 is shown. The cam disk 76 has a link 78 within which a pin 80 is guided via which the cam disk 76 is connected to a gear segment 81. The gear segment 81 is rotatably mounted about the axis 82 and meshes with a gear wheel 84 connected to the switch shaft 20 in a rotationally fixed manner. The switch shaft 20 is rotated via the gear segment 81 such that the switch position of the switch 18 can be adjusted according to the position of the gear segment 81.

In the third switch position shown in FIG. 9, i.e. in the switch position in which notes of value can be transported from the second transport path 14 to the third transport path 16 and vice versa, the gear segment 81 is arranged in a lower position. In this lower position, the pin 80 is arranged on a first end of the link 78 of the cam disk 76, wherein this first end is said end which is further away from the rotation center 86 of the cam disk 76. Via rotation of the cam disk 76 with the aid of the stepper motor 70 via the belt 74 the pin 80 moves within the link 78 of the cam disk 76 such that the pin 80 is guided closer to the center 86 of the cam disk 76 and thus the gear segment 81 connected to the pin 80 is pivoted above in the direction of the arrow P8. In this way, the gear wheel 84 is rotated in the direction of the arrow P9, whereby the switch 78 can be adjusted from the third switch position in the first switch position and further in the second switch position.

Further, the gear segment 81 is connected via a pin 88 to a coupling element 90, wherein the coupling element 90 is rotatably connected to the gear segment 81 by the pin 88. On the end of the coupling element 90 opposite to the end connected to the pin 88 with the gear segment 88 the coupling element 90 includes a hole in which a further pin 92 is arranged. A first end of the pin 92 is guided within an oblong hole 94 of a first guiding element 96. The first guiding element 96 is firmly connected to the base plate 50 of the reverse gear 48 and thus firmly connected to the reverse gear 48. The broad end of the pin 92 is guided within a groove 98 of a second guiding element 100. The second guiding element 100 is firmly connected to a stationary rack 102 (see FIG. 8). The groove 98 comprises a first leg 104 and a second leg 106. The two legs 104, 106 in particular span an angle between 100° and 170°. Alternatively, the oblong hole 94 can also be formed directly in the base plate 50.

In the operating state shown in FIG. 9, i.e. in the operating state in which the switch 18 is arranged in the third switch position and the reverse gear 48 is arranged in the second position, the pin 92 is arranged on a lower end of the oblong hole 94 and on the end of the first leg 104 opposite to the second leg 106.

Figure 10:
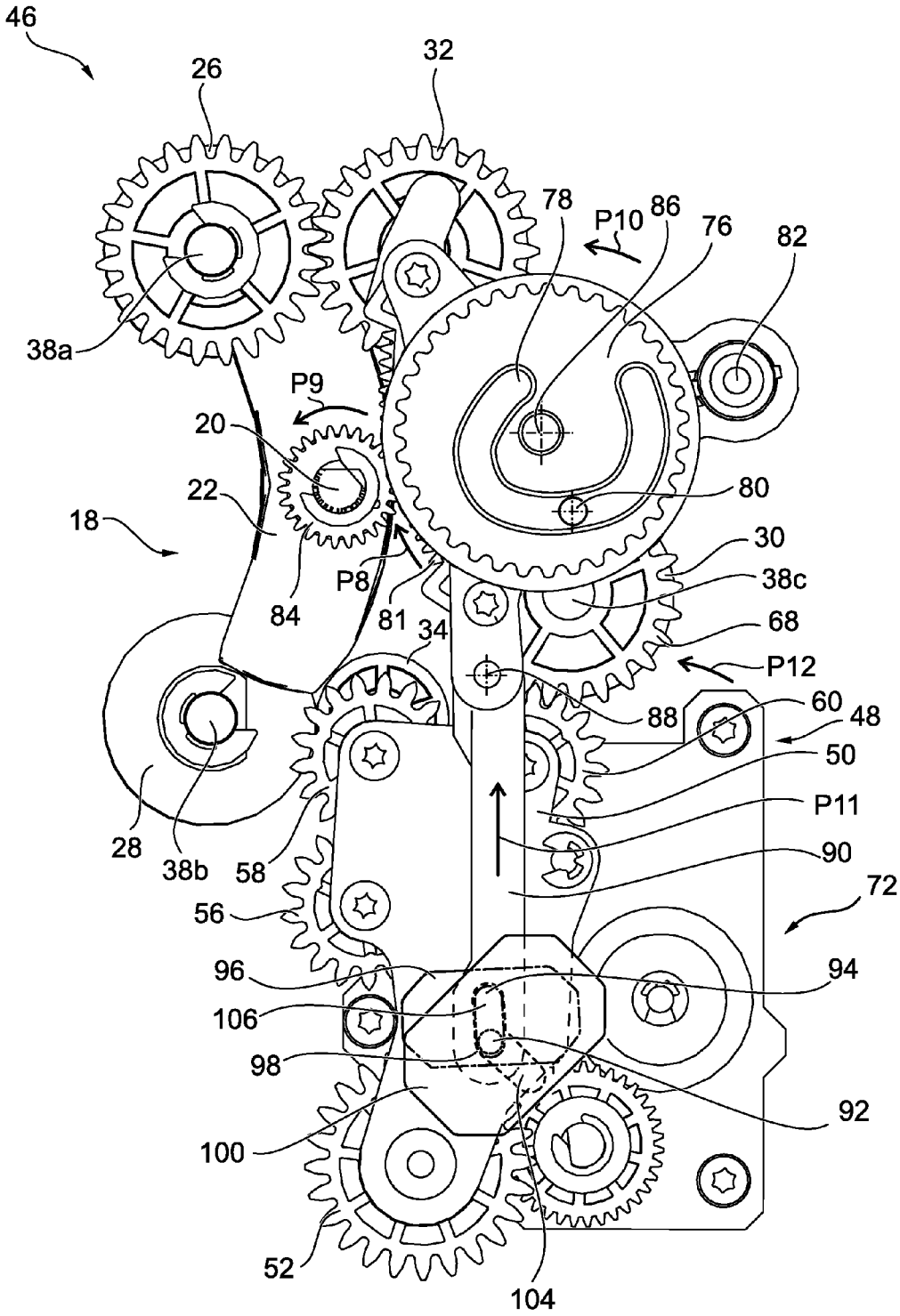
FIG. 10 shows a schematic illustration of the adjustment arrangement according to FIG. 9 in the first switch position and the first position of the reverse gear.

In FIG. 10, a schematic perspective illustration of the adjustment arrangement 46 in the first switch position and the first position of the reverse gear 48 is shown. Compared to the operating state shown in FIG. 9, the cam disk 76 has been rotated in the direction of the arrow P10. In this way, the pin 80 has been moved within the link 78 such that said pin 80 is arranged closer to the center 86 of the cam disk 76, whereby in turn the gear segment 81 has been pivoted in the direction of the arrow P8 such that the gear segment 81 is arranged in a middle position. In this middle position 81, the gear wheel 84, which is engaged with the gear segment 81 and connected to the switch shaft 20 in a rotationally fixed manner, has been rotated in the direction of the arrow P9 compared to the operating state shown in FIG. 9 such that also the guide fingers 22 connected to the switch shaft 20 have been rotated and thus the switch 18 is arranged in the first switch position. In this first switch position, the notes of value can be transported between the first transport path 12 and the second transport path 16.

By moving the gear segment 81 from the lower in the middle position, the coupling element 90 is also moved in the direction of the arrow P11 above. Here, the pin is moved within the groove 98 of the stationary second guiding element 100 such that the pin 92 is arranged on the position of the groove 98 on which the first leg 104 and the second leg 106 are connected to each other. Here, the leg 92 is still arranged on the lower end of the oblong hole 94 of the first guiding element 96. As the first guiding element 96 is firmly connected to the base plate 50 of the reverse gear 48, the whole reverse gear 48 is pivoted during a movement of the pin 92 within the groove 98 along the first leg 104 from the operating state shown in FIG. 9 to the operating state shown in FIG. 10 in the direction of the arrow P12 and thus from the second position in the first position. Thus, the fifth gear wheel 60 of the reverse gear 48 is now engaged with the gear wheel 68 and not as before in the second position of the reverse gear 48 in FIG. 9 the fourth gear wheel 58 of the reverse gear 48. In this way, it is achieved that while arranging the switch 18 from the third switch position in the first switch position, the reverse gear 48 is automatically arranged from the second position in the first position and thus the direction of rotation of the third drive roll 30 is reversed relative to the direction of rotation of the other two drive rolls 26, 28 such that the notes of value can now be transported between the first transport path 12 and the second transport path 14.

Figure 11:
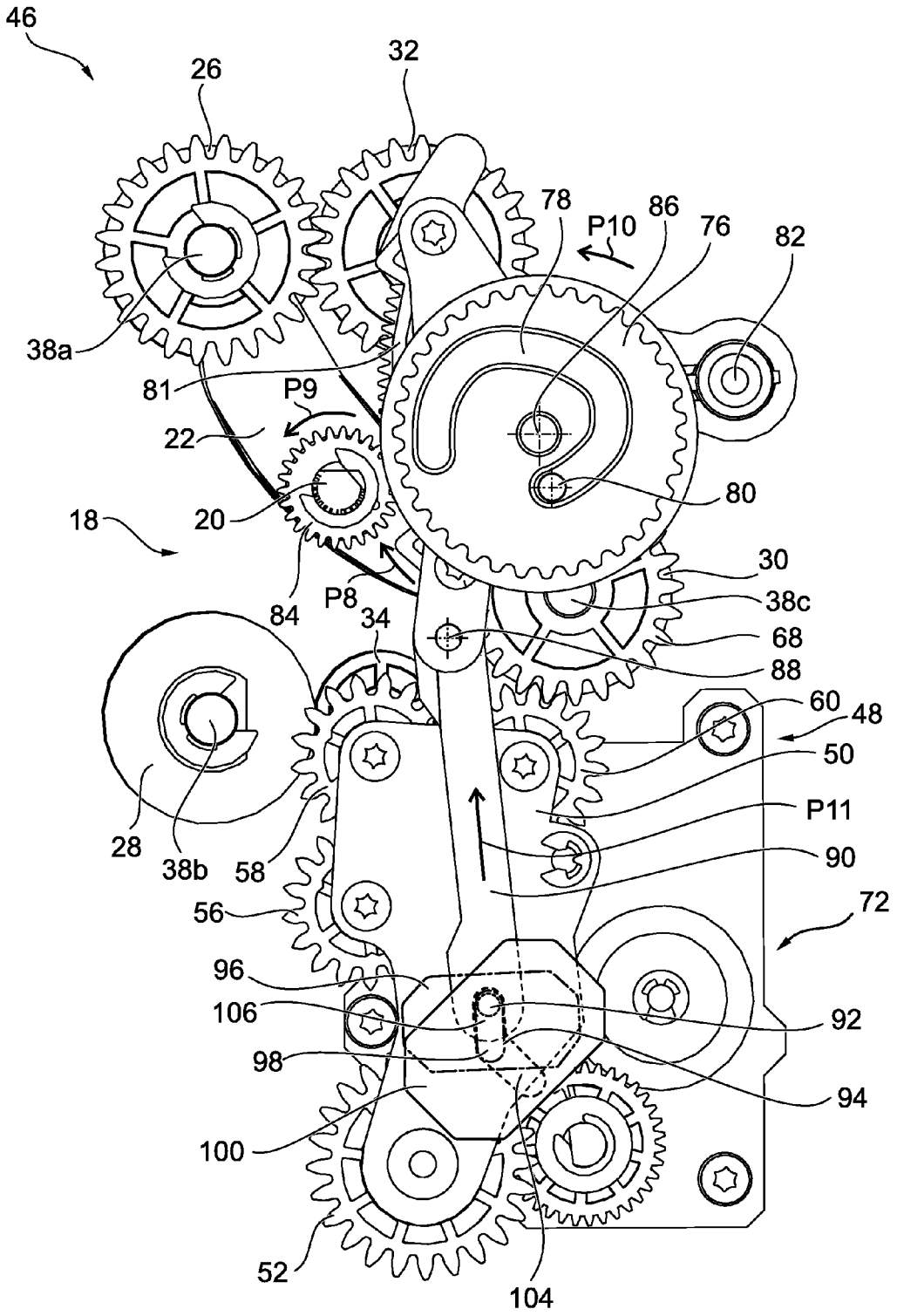
FIG. 11 shows a schematic illustration of the adjustment arrangement according to FIGS. 9 and 10 in the second switch position and the first position of the reverse gear.

In FIG. 11, a schematic perspective illustration of the adjustment arrangement 46 in the second switch position of the switch 18 and the first position of the reverse gear 48 is shown. In the operating state shown in FIG. 11, the cam disk 76 is rotated in the direction of the arrow P10 compared to FIGS. 10 and 9 such that the pin 80 is now also arranged on the second end of the link 78 opposite to the first end of the link 78 and is thus, compared to FIG. 10, still closer arranged to the rotation center 86 of the cam disk 76. In this way, the gear segment 81 is rotated from the middle position shown in FIG. 10 further in the direction of the arrow P8 in an upper position. Thus, the switch 18 is also arranged from the first switch position in the second switch position such that notes of value can be transported between the first transport path 12 and the third transport path 16.

By adjusting the gear segment 81 from the middle in the upper position, the coupling element 90 is also moved further in the direction of the arrow P11 upwards, whereby the pin 92 is also moved upwards. In this way, the first end of the pin 92 is moved upwards within the oblong hole 90 of the first guiding element 96. Likewise, the second end of the pin 92, guided within the second leg 106 of the groove 98 of the second guiding element 100, moves in the direction of the end of the second leg 106 which is not connected to the first leg 104. In this way, it is achieved that the reverse gear 48 still remains in the first position and thus the direction of rotation of the third drive roll 30, during the adjustment of the switch 18 from the first in the second switch position, is not reversed relative to the direction of rotation of the other two drive rolls 26, 28.

By the mechanism, described in FIGS. 9 to 11, for adjusting the switch position and for adjusting the reverse gear 48, in particular by coupling the adjustment of the switch 18 and the reverse gear 48, it is achieved that the reverse gear 48 is automatically adjusted with the switch 18, when this is necessary to reverse the direction of rotation of the third drive roll 30 relative to the direction of rotation of the other two drive rolls 26, 28 and thus to enable the transport of the notes of value in all possible transport directions between the transport paths 12 to 16. Due to the purely mechanical coupling of the switch 18 and the reverse gear 48 any electronic control elements can be dispensed with.

The method described in connection with FIGS. 9 to 11 for adjusting the switch 18 from the third in the first and further in the second switch position takes place in the reverse manner during adjustment from the second in the first switch position and further from the first in the third switch position. That means that during adjustment from the second in the first switch position the reverse gear 48 remains in the first position, whereas during adjustment from the first switch position in the third switch position the reverse gear 48 is pivoted from the first position in the second position.

The cam disk 76 respectively includes a portion on said portions on which the pin 80 is arranged when the gear segment 81 is positioned in the lower, the middle or the upper portion, in which the link 78 has a constant radius and thus a constant distance to the center 86 of the cam disk 76. These portions are also referred to as rest zone. By this rest zone it is achieved that the correct switch position and the correct position of the reverse gear is even adjusted, when the cam disk 76 is rotated a little too far or not as far as intended, e.g. in case of defects of the stepper motor 70. In this way, the functional reliability of the device 10 is increased. As long as the pin is arranged within a rest zone, no adjustment of the gear segment 91 takes place. Thus, in particular fault tolerances of the stepper motor 70 are made up for.

By the guidance of the pin 92 within two links, namely the groove 98 and the oblong hole 94, it is achieved that the reverse gear 48 is only adjusted during adjustment from the first in the third switch position and from the third in the first switch position, but not during adjustment from the first in the second switch position and from the second in the first switch position. In this way, it is achieved that the reverse gear is only adjusted when this is also necessary to reverse the direction of rotation of the third drive roll 30. In this way, it is achieved that less switching operations of the reverse gear 48 are necessary and wear of the reverse gear 48 is reduced. Further, in this way it is achieved that fewer problems arise while the reverse gear 48 is coupled in. In an alternative embodiment of the invention, the switch 18 and the reverse gear 48 can also not be connected to each other, but can respectively be adjusted via separate adjustment units between the individual positions. In particular, the switch 18 and the reverse gear 48 can be respectively adjusted via a proper stepper motor between the individual positions.

Further, in an alternative embodiment of the invention, the reverse gear 48 can also comprise less than five gear wheels 52 to 60 or more than five gear wheels 52 to 60. In particular, the reverse gear 48 can also comprise three gear wheels.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A device for handling notes of value, comprising a first transport path, a second transport path and at least one third transport path, wherein the notes of value are transportable along each of the transport paths, comprising a switch via which the three transport paths are connectable to each other and with the aid of which the notes of value are reroutable from one of the transport paths in another transport path preset by the switch position, comprising at least one first transport element with the aid of which the notes of value are suppliable from the switch to the first transport path and/or from the first transport path to the switch, comprising at least one second transport element with the aid of which the notes of value are suppliable from the switch to the second transport path and/or from the second transport path to the switch, and comprising at least one third transport element with the aid of which the notes of value are suppliable from the switch to the third transport path and/or from the third transport path to the switch, wherein the first transport element, the second transport element and the third transport element are driven by the same drive unit, wherein the direction of rotation of at least one of the transport elements is reversible independently from the directions of rotation of the other two transport elements.

2. The device according to claim 1, wherein in a first operating state the first transport element has a first direction of rotation, the second transport element has a second direction of rotation and the third transport element has a third direction of rotation, and that in a second operating state the first transport element has the first direction of rotation, the second transport element has the second direction of rotation and the third transport element has a fourth direction of rotation opposite to the third direction of rotation.

3. The device according to claim 1, wherein in a first operating state the first transport element has a first direction of rotation, the second transport element has a second direction of rotation and the third transport element has a third direction of rotation, and that in a third operating state the first transport element has a fifth direction of rotation opposite to the first direction of rotation, the second transport element has a sixth direction of rotation opposite to the second direction of rotation and the third transport element has the third direction of rotation.

4. The device according to claim 2, wherein the first direction of rotation, the second direction of rotation and the third direction of rotation are identical.

5. The device according to claim 1, wherein in a first switch position of the switch notes of value are transportable from the first transport path to the second transport path and/or from the second transport path to the first transport path, that in a second switch position notes of value are transportable from the first transport path to the third transport path and/or from the third transport path to the first transport path, and that in a third switch position notes of value are transportable from the second transport path to the third transport path and/or from the third transport path to the second transport path.

6. The device according to claim 5, wherein the switch comprises a switch shaft on which at least one guiding finger for guiding the notes of value is arranged in a rotationally fixed manner, that the switch shaft is engaged, in particular via a gear wheel arrangement, with a cam disk, that the cam disk is rotatable with the aid of an adjustment unit in at least a first, a second and a third preset position, and that the switch shaft is respectively rotated in one of the three switch positions depending on the position of the cam disk.

7. The device according to claim 5, wherein in the first switch position and the second switch position the transport elements are in the first operating state, and that in the third switch position the transport elements are in the second operating state or in the third operating state.

8. The device according to claim 1, wherein the device comprises a reverse gear, which in a first position drives the third transport element with the same direction of rotation with which the first transport element rotates and which in a second position drives the third transport element with the direction of rotation opposite to the direction of rotation of the first transport element.

9. The device according to claim 8, wherein the reverse gear comprises a first gear wheel, which in the first position meshes with a gear wheel connected to the third transport element in a rotationally fixed manner, and that the reverse gear comprises a second gear wheel, which in the second position meshes with the gear wheel connected to the third transport element in a rotationally fixed manner, wherein in the first position the second gear wheel does not contact the gear wheel connected to the third transport element in a rotationally fixed manner, wherein in the second position the first gear wheel does not contact the gear wheel connected to the third transport element in a rotationally fixed manner, and wherein the first gear wheel and the second gear wheel are engaged with each other.

10. The device according to claim 8, wherein the reverse gear is driven by the drive unit.

11. The device according to claim 8, wherein the reverse gear is connected via a coupling element to the switch, that an adjustment unit is provided, which adjusts the switch positions of the switch, that in the first switch position the reverse gear is arranged in the first position, that in the second switch position the reverse gear is arranged in the first position, and that in the third switch position the reverse gear is arranged in the second position, wherein the adjustment unit pivots the reverse gear via the connection via the coupling element from the first position in the second position, when the adjustment unit adjusts the switch from the first switch position in the third switch position or from the second switch position in the third switch position, and wherein the adjustment unit pivots the reverse gear via the connection via the coupling element from the second position in the first position, when the adjustment unit adjusts the switch from the third switch position in the first switch position or from the third switch position in the second switch position.

12. The device according to claim 11, wherein a pin stationarily connected to the coupling element is guided within an oblong hole of a first guiding element firmly connected to the reverse gear, and that the pin is guided within a groove of a stationary second guiding element, wherein the groove of the second guiding element comprises a first leg and a second leg, and wherein the first leg and the second leg span an angle between 100° and 170°.

13. The device according to claim 1, wherein the first transport element, the second transport element and/or the third transport element comprise respectively at least one roll, at least one belt and/or at least one roller.

14. The device according to claim 1, wherein the first transport element, the second transport element and/or the third transport element respectively have at least one pair of rolls comprising at least two rolls, wherein preferably one of the rolls is a drive roll driven by the drive unit, wherein the other roll is a non-driven pressure roll, and wherein the notes of value are transported through the rolls.

15. The device according to claim 1, wherein the first transport element is arranged on a first shaft in a rotationally fixed manner, the second transport element is arranged on a second shaft in a rotationally fixed manner and the third transport element is arranged on a third shaft in a rotationally fixed manner, and that the direction of rotation of at least one of the shafts (38*a* to 38*c*) is reversible relative to the direction of rotation of the other two shafts (38*a* to 38*c*).

* * * * *